United States Patent [19]

Shpigelman

[11] Patent Number: 4,520,968

[45] Date of Patent: Jun. 4, 1985

[54] DISPENSING DEVICE FOR CYLINDRICAL BODIES, SUCH AS ROLLS OF TOILET PAPER, PAPER TOWELS AND THE LIKE

[76] Inventor: David Shpigelman, 1 Mavo Gilat, Ramath Zahla, Tel Aviv, Israel

[21] Appl. No.: 543,906

[22] Filed: Oct. 20, 1983

[30] Foreign Application Priority Data

Oct. 20, 1982 [IL] Israel ..... 67028

[51] Int. Cl.[3] ..... B65H 19/04

[52] U.S. Cl. ..... 242/55.3; 225/47

[58] Field of Search ..... 242/55.3, 55.42, 55.53, 242/129.51, 129.53; 225/46, 47, 53; 312/38–40; 248/DIG. 5; 74/25, 89

[56] References Cited

U.S. PATENT DOCUMENTS

| | | | |
|---|---|---|---|
| 1,981,590 | 11/1934 | Easterling | 242/55.53 |
| 2,815,576 | 12/1957 | Gerstner | 242/55.2 |
| 2,896,871 | 7/1959 | Woodruff | 242/55.3 |
| 3,130,932 | 4/1964 | Pena | 242/55.3 |
| 3,279,715 | 10/1966 | Vedvig | 242/55.3 |
| 4,105,168 | 8/1978 | Rutherford | 242/55.2 |
| 4,368,859 | 1/1983 | Focke et al. | 242/130 |

*Primary Examiner*—Leonard D. Christian

*Attorney, Agent, or Firm*—Toren, McGeady, Stanger

[57] ABSTRACT

A dispenser for rolls of toilet paper, towels and the like in which a plurality of rolls are stacked vertically in a magazine with the axes of the rolls disposed normal to the vertical extension of the stack. A dispensing and holding mechanism comprises a cylindrical body mounted within the magazine body mounted within the magazine and below the stack. The body has a central axle and two radially extending arms biased toward one another by tension springs, the arms each have an oppositely directed stud adapted to enter the hollow core of a roll. The cylindrical body has opposed circular ends forming a number of cam paths, the roll supporting radial arms extending across and in contact with a respective one of the cam paths and being urged towards the opposite cam paths by the tension spring for imparting rotating movement to the cylindrical body about its central axis to deliver a roll from the vertical stack to a dispensing position.

5 Claims, 7 Drawing Figures

DISPENSING DEVICE FOR CYLINDRICAL BODIES, SUCH AS ROLLS OF TOILET PAPER, PAPER TOWELS AND THE LIKE

FIELD AND BACKGROUND OF INVENTION

The present invention concerns a dispenser for roll shaped bodies, such as rolls of toilet paper, paper towels and the like, i.e. commodities which are held on a holder and are exposed for a consumer to tear off a length of material.

The conventional manner of holding the said commodities at the disposal of a consumer is by holding them on a turnable axle which—in turn—is removably held in horizontal position at both its ends. The paper or other material is wound on a hollow reel, conventionally an expendable cardboard reel, and whenever the paper—or other material—on the reel has been consumed, the reel has to be removed from the said axle and a fresh roll has to be placed on the axle.

OBJECTS OF INVENTION

It is the object of this invention to provide a dispenser in which a number of rolls can be kept at readiness to be transferred from a storage magazine into a position of availability to the consumer.

SHORT SUMMARY OF DISCLOSURE

Accordingly, there is provided a dispenser which comprises a magazine in which a stack of rolls is positionable with the axes of the rolls normal to the vertical extension of the stack, a dispensing and holding mechanism being positioned below the said stack, such mechanism comprising two arms radially extending relative to a cylindrical body the two opposite circular ends of which form a number of cam paths, the said arms being hingedly, angularly movable towards and away from one another, and having oppositely directed studs at their free ends, adapted to enter a hollow reel of a roll, the arms extending across the said cam paths and being urged towards one another by a tension spring affixed to both arms, means being provided to impart rotative movement to the said cylindrical body.

SHORT DESCRIPTION OF DRAWINGS

The above and further features of the invention will now be described with reference to the annexed drawings wherein:

FIG. 1 is a perspective view of the new dispenser.

FIG. 2, being an elevational, lateral view, with a side wall removed.

DESCRIPTION OF PREFERRED EMBODIMENT

Figure 1:
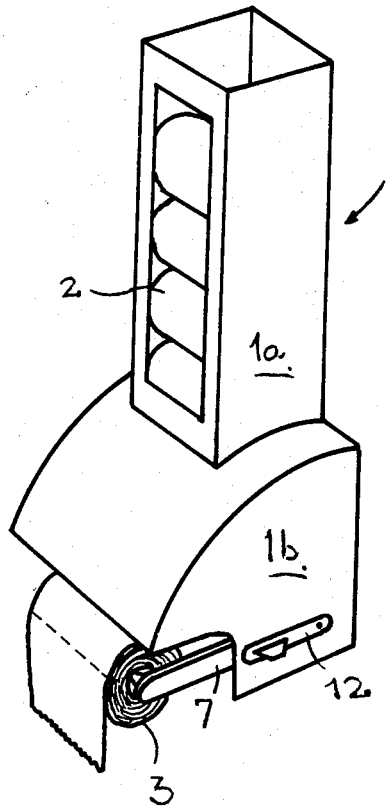
Figure 2:
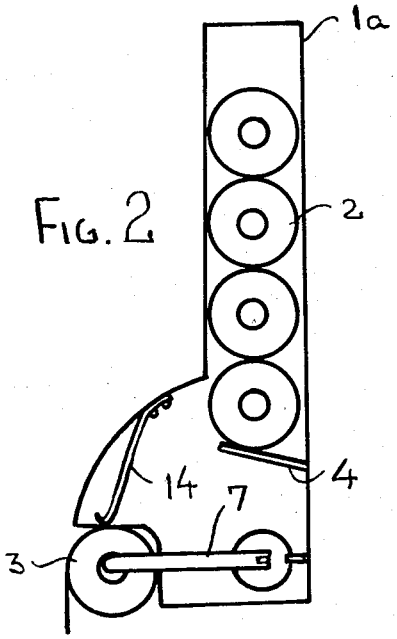

The new dispensing device comprises a housing, generally indicated by the numeral 1 and consisting of two compartments: compartment 1*a* which is a magazine in which a stack 2 of cylindrical bodies, say rolls of toilet paper are stored, and compartment 1*b* in which a mechanism is enclosed by means of which the bodies 2 are transferred from storage in compartment 1*a* to the position shown in FIGS. 1 and 2, i.e. being held—at 3—in readiness for use by a consumer.

Figure 3:
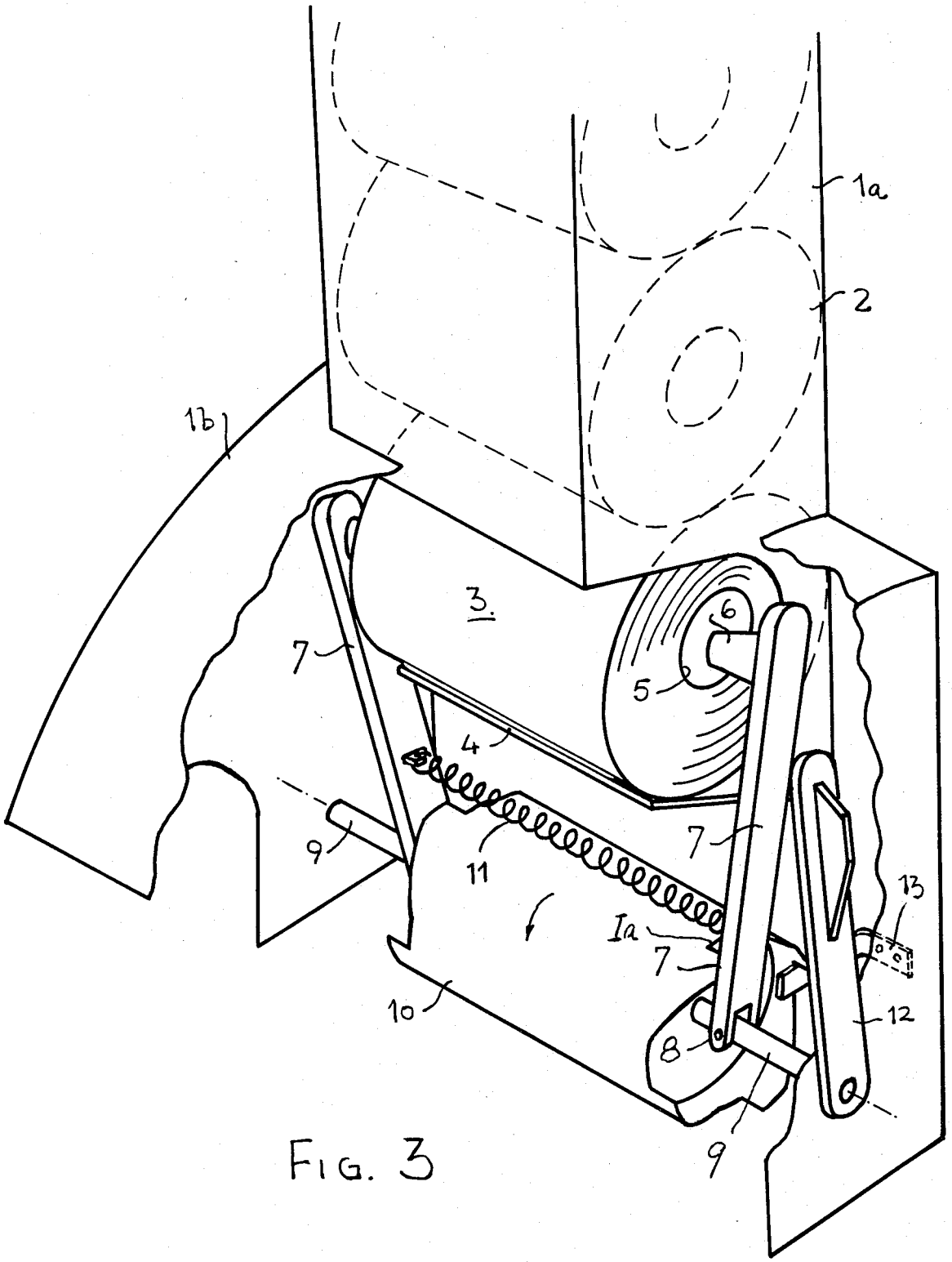
FIG. 3 is a view showing the lowermost roll in the stack being about to be engaged by the holding arms.
Figure 6:
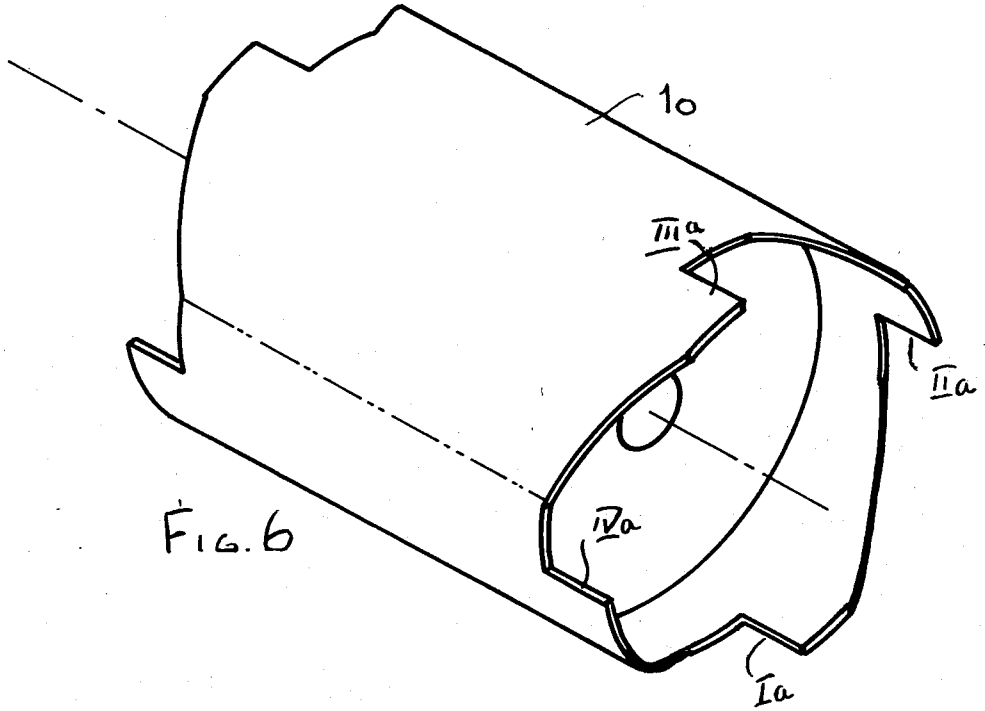
FIGS. 6 and 7 are detail views which show constructional details.
Figure 7:
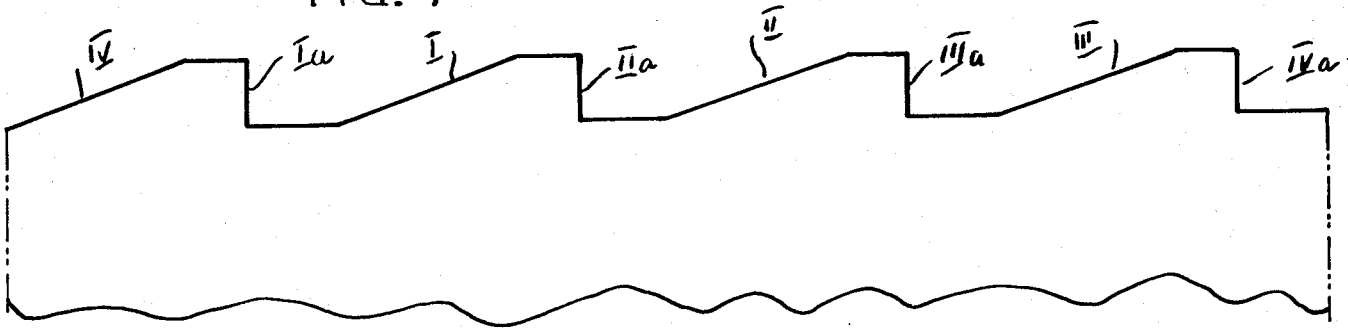

Turning now to FIG. 3: The stack 2 of paper rolls comprises the lowermost roll 3 which rests on a shelf 4. As usual the paper is wound on a hollow reel 5 into which can enter studs 6 extending from two arms 7 which are hingedly connected at 8 to an axle 9 on which a cylindrical body 10 turns freely. The two circular end faces of body 10 are formed to act as cam paths, as shown in FIGS. 6 and 7 (the latter being a development into a plane, of the cylinder).

As can be seen, there are four cam paths, I, II, III, IV each of which terminates at a shoulder Ia, IIa, IIIa, IVa. These shoulders (see FIG. 6) extend in the axial direction of cylinder 10.

The two arms 7 can swing apart and outwardly about the hinges 8, against the bias of a tension spring 11 which is connected to both arms 7.

The axle 9 can be rotated by means of a handle 12 (FIGS. 1 and 5) keyed on that axle and being positioned at the outside of compartment 1*b*.

To the rear wall of compartment 1*b* is riveted an angular member 13 the forewardly extending free end of which forms a springy detent cooperating with any one of shoulders Ia–IVa, as will become clear later.

As can be seen in FIG. 2, a springy finger 14 affixed to the inside of the forward wall of compartment 1*b* bears down or the roll 3 which—at the FIG. 2—is in position of availability to a consumer, The purpose of finger 14 will become clear later.

The new dispenser is operated as follows: Starting from the position of FIG. 3 the handle 12 is swung clockwise. In the position of FIG. 3 the two arms are about to reach their extreme angular position from one another and the spring 11 is almost fully expanded. With a short further clockwise turn of handle 12 the two arms—riding on a cam path (in FIG. 3—cam path I) arrive at shoulder 1*a* and under tension of spring 11 snap towards one another and stop firmly lying against the shoulder I. As a result the studs 6 enter the cavity of roll 5.

Figure 4:
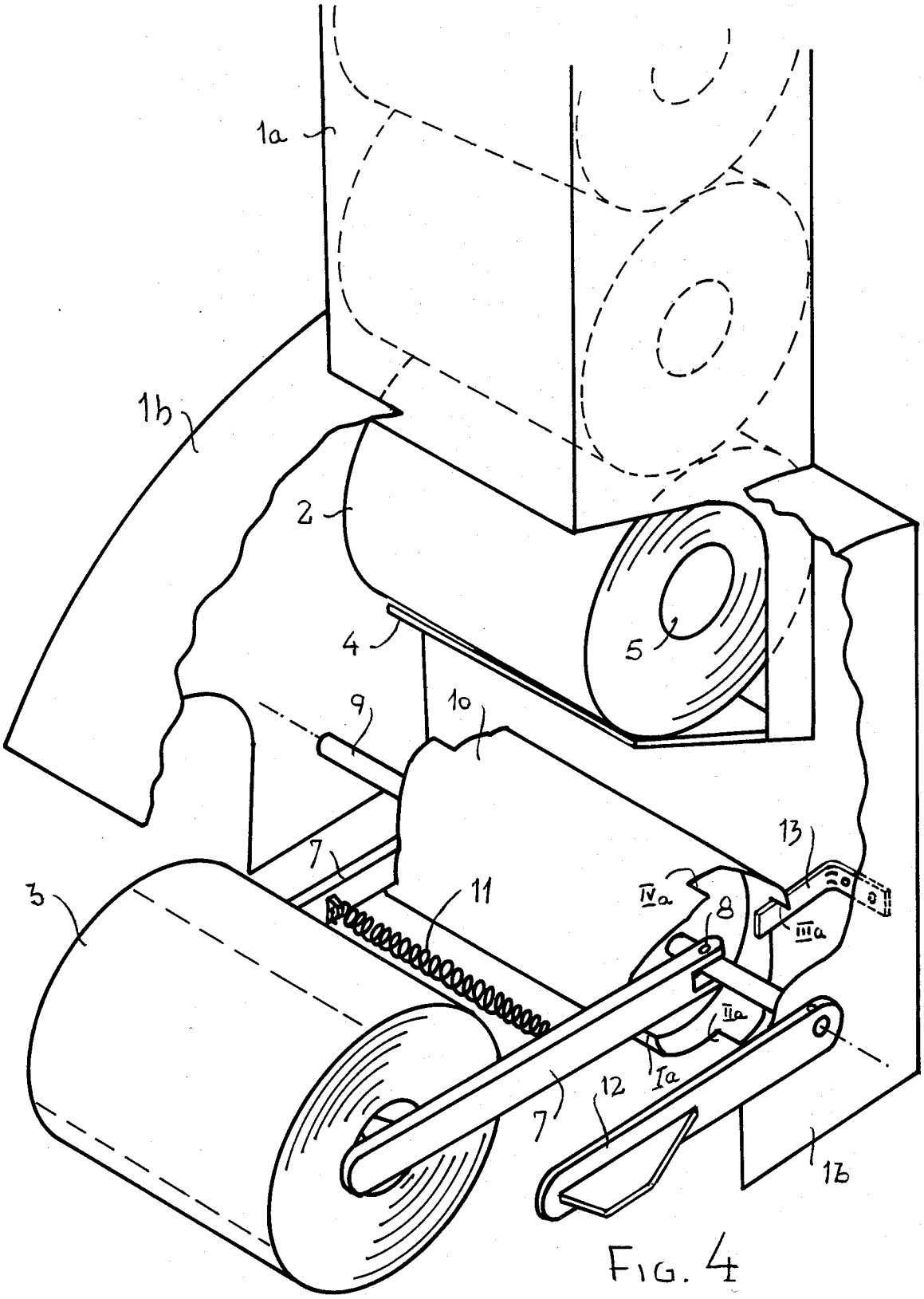
FIG. 4 is a perspective view of the dispenser in operative position, holding a roll accessible to a consumer.

Now the handle 12 can be turned anticlockwise (and revolving cylinder 10 which engages shoulder Ia) thereby removing the roll 3 from shelf 4 and holding it in the position shown in FIG. 4, i.e. being accessible to a consumer.

In the position of FIG. 4 the spring 11 has contracted, the arms 7 rest on shoulder Ia.

Figure 5:
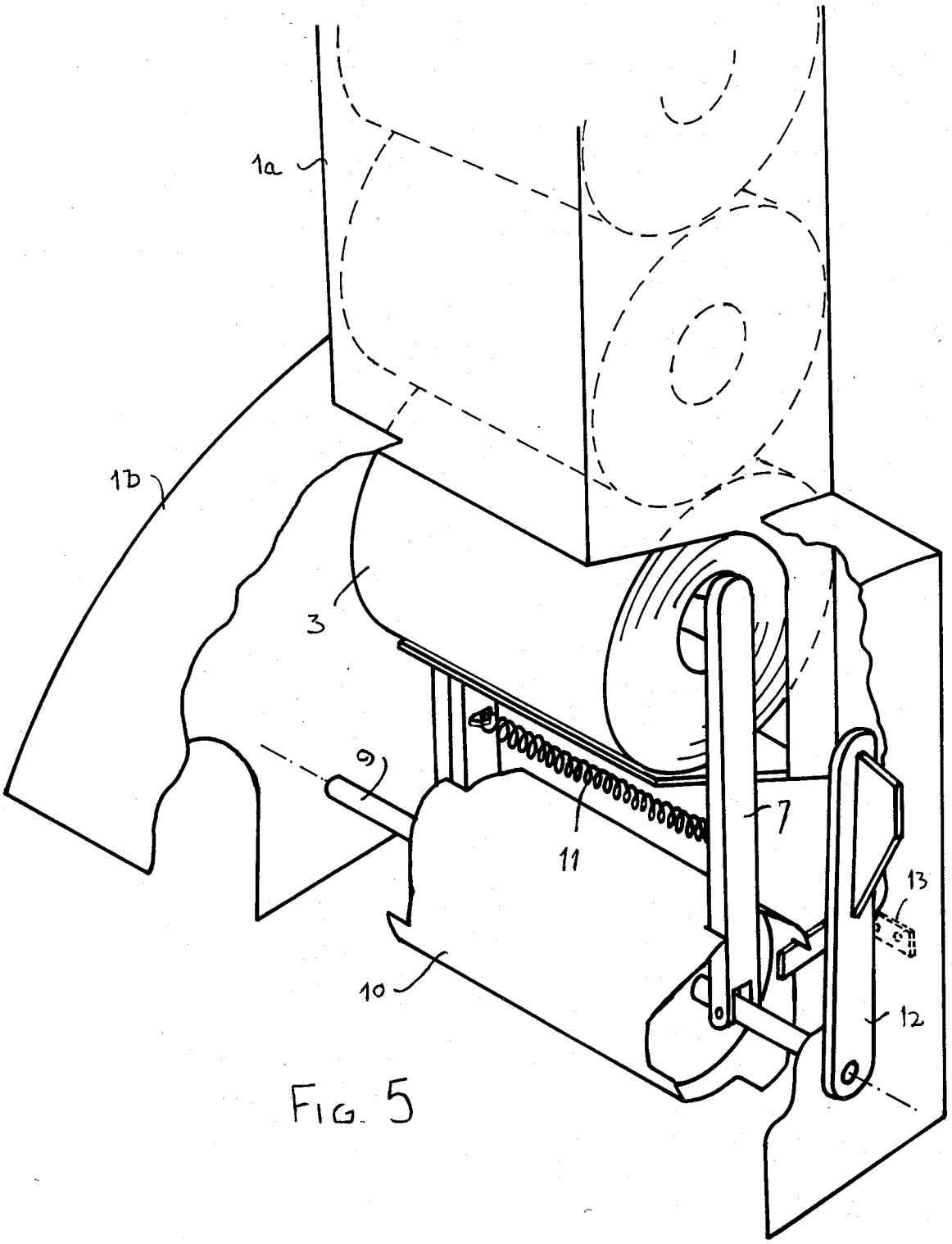
FIG. 5 shows—in a like view—the dispenser having engaged the lowermost roll in the stack, at the instant prior to its being transferred into position of use, i.e. being accessible to the consumers.

If now the handle 12 is again swung clockwise (assuming that the whole of roll 3 has been spent and only the reel 5 remains in position), the arm 7 get out of contact with shoulder Ia riding on path IV will move apart, dropping the reel and will snap close at shoulder IVa assuming the position of FIG. 5. Now by anticlockwise movement of handle 12 the lowermost roll in the stack is brought into position of readiness, i.e. as shown in FIG. 4.

The angular member 13 serves to stop rotation of body 10 during the clockwise rotation, by abutting against one of the shoulder Ia–IVa whichever might be nearest to the angular member. Accordingly, rotation of body 10 proceeds in one direction only.

The springy finger 14 prevents a raising of arms 7 as long as there is paper on the roll, i.e. it makes it impossible to raise the roll and drop it out of the compartment 1*b*. Only the empty reel permits passage at the upward movement of arms 7. In this way theft of a roll of paper can be prevented in those cases where the dispenser is put up at places which are accessible to the public.

I claim:

1. A dispensing device for cylindrical bodies, such as rolls of toilet paper, paper towels and the like, said device comprising a magazine in which a vertical stack of rolls is positionable with the axes of the rolls normal to the vertical extension of the stack, a dispensing and holding mechanism being positioned below the said stack, said mechanism comprising a cylindrical body mounted within said magazine and arranged below the stack and having a central axle, two arms extending radially relative to said cylindrical body, a tension spring fixed to each of said arms and biasing said arms toward one another, said cylindrical body having a pair of opposite circular ends each forming a number of cam paths, said arms being hingedly mounted on said axle and being angularly movable towards and away from one another, said arms each having a free end spaced outwardly from said axle and each free end mounting a stud oppositely directed to said stud on the other said arm, said studs adapted to enter a hollow reel of a roll, each said arm extending across and in contact with one of said cam paths and being urged towards the other said cam paths by said tension spring and means for imparting rotative movement to the said cylindrical body about said central axle.

2. The dispensing device claimed in claim 1, wherein said magazine is upwardly extending and a shelf located in the lower part of the said magazine and arranged to form a support for the lowermost roll in the stock.

3. The dispensing device claimed in claim 1, wherein said cylindrical body of the mechanism has four cam paths at each said circular end.

4. The dispensing device claimed in claim 1, wherein a casing extends downwardly from said magazine and encloses the mechanism, a detent is mounted in said casing in contact with one of said circular ends for permitting rotating movement of said cylindrical body of said mechanism in one sense only.

5. The dispensing device claimed in claim 1, wherein a casing is located at the lower end of said magazine and laterally encloses said mechanism, and a springy finger mounted in said casing and arranged to press against the roll secured by said arms in a position of availability to a consumer.

* * * * *